US011933321B2

(12) United States Patent
Tischler et al.

(10) Patent No.: US 11,933,321 B2
(45) Date of Patent: Mar. 19, 2024

(54) ROTARY PUMP FOR CONVEYING A FLUID

(71) Applicant: Sulzer Management AG, Winterthur (CH)

(72) Inventors: Heike Tischler, Winterthur (CH); Thomas Welschinger, Radolfzell (DE); Laurent Chatagny, Fehraltorf (CH); Stefan Berten, Winterthur (CH)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 17/565,728

(22) Filed: Dec. 30, 2021

(65) Prior Publication Data

US 2022/0220980 A1 Jul. 14, 2022

(30) Foreign Application Priority Data

Jan. 13, 2021 (EP) ..... 21151344

(51) Int. Cl.
*F04D 29/66* (2006.01)
*F04D 29/043* (2006.01)
(Continued)

(52) U.S. Cl.
CPC ..... *F04D 29/669* (2013.01); *F04D 29/043* (2013.01); *F04D 29/18* (2013.01); *F04D 29/406* (2013.01)

(58) Field of Classification Search
CPC . F04D 29/0413; F04D 29/051; F04D 29/2266
See application file for complete search history.

(56) References Cited

U.S. PATENT DOCUMENTS 2,221,225 A * 11/1940 Weis ..... F04D 29/0416 415/104
5,713,720 A 2/1998 Barhoum
(Continued)

FOREIGN PATENT DOCUMENTS

DE 1453787 A1 5/1969

OTHER PUBLICATIONS

Extended European Search Report issued Jun. 22, 2021 in corresponding European Patent Application No. 21151344.5, filed Jan. 13, 2021.

*Primary Examiner* — Brian O Peters
(74) *Attorney, Agent, or Firm* — GLOBAL IP COUNSELORS, LLP

(57) ABSTRACT

A rotary pump includes a balance drum connected to a pump shaft between a hydraulic unit and the pump shaft, an axial relief passage between a balance drum and a stationary part stationary relative to a pump housing, and a balancing device arranged between the balance drum and the hydraulic unit, the balancing device including a ring-shaped rotary part connected to the pump shaft, and a ring-shaped non-rotary part movable only in the axial direction, the rotary part having an axial face facing the hydraulic unit, the rotary part and the non-rotary part overlap in a radial direction, which is perpendicular to the axial direction, and the non-rotary part movable in the axial direction such that a radial relief passage is open during operation of the pump, with the radial relief passage extending in the radial direction between the rotary part and the non-rotary part.

16 Claims, 2 Drawing Sheets

(51) Int. Cl.
*F04D 29/18* (2006.01)
*F04D 29/40* (2006.01)

(56) References Cited

U.S. PATENT DOCUMENTS 5,827,042 A * 10/1998 Ramsay ..... F16C 17/105
415/231
2010/0068031 A1 3/2010 Marcelli

* cited by examiner

ROTARY PUMP FOR CONVEYING A FLUID

CROSS-REFERENCE TO RELATED APPLICATION

This application claims priority to European Patent Application No. 21151344.5, filed Jan. 13, 2021, the contents of which are hereby incorporated by reference in their entirety.

BACKGROUND

Field of the Invention

The disclosure relates to a rotary pump for conveying a fluid.

Background Information

Rotary pumps for conveying a fluid, for example a liquid such as water, are used in many different industries. Examples are the oil and gas industry, the power generation industry, the chemical industry, the water industry or the pulp and paper industry. Conventional rotary pumps have at least one impeller and a pump shaft for rotating the impeller. The at least one impeller can be configured for example as a radial impeller or as an axial or semi-axial impeller or as a helicoaxial impeller. Furthermore, the impeller can be configured as an open impeller or as a closed impeller, where a shroud is provided on the impeller, said shroud at least partially covering the vanes of the impeller.

A rotary pump can be designed as a single stage pump having only one impeller mounted to the shaft or as a multistage pump comprising a plurality of impellers, wherein the impellers are arranged one after another on the shaft. The impellers can be arranged in an in-line arrangement, where the axial thrust generated by a single impeller is directed in the same direction for all impellers, or in a back-to-back arrangement, where the axial thrust generated by a first group of impellers is directed in the opposite direction as the axial thrust generated by a second group of impellers.

Many rotary pumps are provided with at least one balancing device or balancing system for at least partially balancing the axial thrust that is generated by the impeller(s) during operation of the pump. The balancing device reduces the axial thrust that has to be carried by the axial bearing or the thrust bearing. The balancing device can comprise a balance drum for at least partially balancing the axial thrust that is generated by the rotating impellers. The balance drum is fixedly connected to the pump shaft of the pump in a torque proof manner. Usually, in a single stage pump or in a multistage pump with in-line arrangement of the impellers the balance drum is arranged at the discharge side of the pump between the last stage impeller and a shaft sealing device. In a multistage pump with a back-to-back arrangement of impellers the balance drum is usually located adjacent to an intermediate stage impeller, which is arranged at one end of the hydraulic unit comprising all the impellers. The balance drum defines a front side and a back side. The front side is the side facing the hydraulic unit. The back side is the side facing the shaft sealing device.

A relief passage is provided between the balance drum and a stationary part being stationary with respect to the pump housing. The back side is usually connected to the suction side or a low pressure location of the pump by means of a balance line. At the low pressure location a pressure prevails, which is smaller than the pressure at the front side.

During operation there is a leakage flow through the relief passage from the front side along the balance drum to the back side and from there through the balance line to the suction side. At the front side of the balance drum the higher pressure or the discharge pressure prevails, and at the back side essentially the suction pressure or the low pressure prevails. The pressure difference between the front side and the back side results in an axial force or an axial thrust which is directed in the opposite direction as the axial thrust generated by the rotating impeller(s). Thus, the axial thrust that has to be carried by the axial or thrust bearing is at least considerably reduced. Of course, the leakage flow along the balance drum results in a decrease of the hydraulic performance or efficiency of the pump. Therefore, the relief passage is configured such, that the leakage flow is low but still sufficient for generating the axial thrust counteracting the axial thrust generated by the impeller(s).

SUMMARY

It has been determined that nowadays in many applications the most efficient use of the pump is strived for. It is desirable to have the highest possible ratio of the power, especially the hydraulic power, delivered by the pump to the power needed for driving the pump. This desire is mainly based upon an increased awareness of environment protection and a responsible dealing with the available resources as well as on the increasing costs of energy. As already said, the flow of the fluid passing along the balance drum through the relief passage, which is in most cases the main leakage flow occurring in the pump, reduces the efficiency of the pump.

It is therefore an object of the disclosure to propose a rotary pump for conveying a fluid, having a reduced leakage flow through the balancing system and therewith an increased efficiency without reducing the balancing of the axial thrust acting on the pump shaft during operation of the pump.

The subject matter of embodiments of the invention satisfying this object is characterized by the features disclosed herein.

Thus, according to an embodiment of the invention, a rotary pump for conveying a fluid is proposed, comprising a pump housing with an inlet for receiving the fluid having a suction pressure, an outlet for discharging the fluid having a discharge pressure, a pump shaft configured for rotating about an axial direction, and a hydraulic unit for conveying and pressurizing the fluid, wherein the hydraulic unit comprises at least one impeller fixedly mounted on the pump shaft, the pump further comprising a balance drum fixedly connected to the pump shaft and arranged between the hydraulic unit and an end of the pump shaft, wherein the balance drum defines a front side facing the hydraulic unit and a back side facing away from the hydraulic unit, wherein an axial relief passage is disposed between the balance drum and a stationary part configured to be stationary with respect to the pump housing, wherein a balance line is provided connecting the back side with a low pressure location, wherein an additional balancing device is arranged between the balance drum and the hydraulic unit, the additional balancing device comprising a ring-shaped rotary part fixedly connected to the pump shaft, and a ring-shaped non-rotary part, which is movable only in the axial direction, wherein the rotary part has an axial face facing the hydraulic unit, wherein the rotary part and the non-rotary part are configured to overlap with respect to a radial direction, which is perpendicular to the axial direction, and wherein the non-rotary part is configured to be movable in the axial direction such that a radial relief passage is open during operation of the pump, with the radial relief passage extending in the radial direction between the rotary part and the non-rotary part.

The combined balancing system comprising the balance drum and the additional balancing device is located adjacent to the hydraulic unit with the at least one impeller. The non-rotary part of the additional balancing device is configured such that it is movable forth and back in the axial direction but cannot rotate. Depending of the specific embodiment of the pump the movement of the non-rotary part can be caused for example by hydraulic forces only, or by a combination of at least two different types of force, e.g. a hydraulic force in combination with a spring force, or—in particular in a vertical pump with the pump shaft extending in the vertical direction (direction of gravity)—a hydraulic force in combination with a gravitational force, or a hydraulic force in combination with a magnetic force. Of course, also other combinations of forces can be used to move the non-rotary part. According to a preferred embodiment, the non-rotary part is spring-loaded by a spring element, wherein the spring element exerts a force on the non-rotary part, which is directed towards the rotating part of the additional balancing device. Preferably the spring element is configured such that the non-rotary part is pressed against the rotary part of the additional balancing device at standstill of the pump.

During start-up of the pump the hydraulic force acting both on the non-rotary part and the rotary part increases until the pump reaches its nominal speed. Since the non-rotary part of the additional balancing device is movable in the axial direction the hydraulic force pushes the non-rotary part away from the rotary part for example against the force of a spring element or against the force of a magnet, such as a permanent magnet, so that the radial relief passage opens between the rotary part and the non-rotary part of the additional balancing device. The fluid flows through the radial relief passage, which is also referred to as radial labyrinth, to the front side of the balance drum and then through the axial relief passage along the balance drum to the back side and into the balance line.

By this combination of an radial relief passage and an axial relief passage, wherein the radial relief passage is arranged between the hydraulic unit and the axial relief passage the overall leakage flow through the additional balancing device and along the balance drum can be considerably reduced as compared to known balancing systems having a balance drum only. Although the overall leakage flow is considerably reduced the balancing action regarding the axial thrust is at least not reduced as compared to known balancing systems.

Within this application a "radial relief passage" or "radial gap" or a "radial labyrinth" designates a passage which extends in the radial direction, such that the fluid passing through said passage flows in radial direction, i.e. in a direction perpendicular to the pump shaft.

Furthermore, within this application an "axial relief passage" or an "axial gap" or an "axial labyrinth" designates a passage which extends in the axial direction, such that the fluid passing through said passage flows in the axial direction, i.e. in a direction parallel to the pump shaft.

According to a preferred configuration, the balance drum delimits an annular chamber arranged at the front side, wherein the annular chamber extends between the rotary part and the non-rotary part with respect to the radial direction. Thus, during operation of the pump, in the annular chamber an intermediate pressure prevails, which is smaller than the pressure acting on the axial face of the rotary part, e.g. the discharge pressure, and which is larger than the pressure at the low pressure location, e.g. the suction pressure.

Preferably, the non-rotary part comprises a first axial face and a second axial face delimiting the non-rotary part with respect to the axial direction, wherein the first axial face is arranged to be exposed to the same pressure as the axial face of the rotary part facing the hydraulic unit, and wherein the second axial face is arranged to be exposed to the pressure prevailing in the annular chamber, i.e. the intermediate pressure. Thus, the width of the radial relief passage, i.e. the extension of the radial relief passage in the axial direction is self-adjusting.

If, during operation of the pump, the pressure acting of the first axial face of the non-rotary part increases, the width of the radial relief passage increases, meaning that the radial relief passage becomes broader with respect to the axial direction. Consequently the leakage flow through the radial relief passage increases, whereby the resistance for the fluid flowing through the axial relief passage along the balance drum increases. This leads to an increase of the intermediate pressure prevailing in the annular chamber. Since the second axial face of the non-rotary part is exposed to the intermediate pressure prevailing in the annular chamber, the force acting on said second axial face increases and, hence, the non-rotary part of the additional balancing device moves towards the rotary part, whereby the width of the radial relief passage is reduced.

According to a preferred embodiment the non-rotary part comprises a third axial face, which is arranged between the first axial face and the second axial face with respect to the axial direction, wherein the third axial face is exposed to the same pressure as the first axial face during operation of the pump. This configuration renders possible that the additional balancing device with the rotary part and the non-rotary part reduces the leakage flow along the balance drum, but does not influence, at least not in a significant manner, the axial thrust compensation Preferably, a ring-shaped sealing element is arranged at the radially outer surface of the non-rotary part, wherein the ring-shaped sealing element is arranged between the second axial face and the third axial face with respect to the axial direction. The ring-shaped sealing element seals the pressure difference between the pressure acting on the first and the third axial face on the one side, which is e.g. the discharge pressure, and the pressure acting on the second axial side, which is the intermediate pressure.

Furthermore, it is preferred that the ring-shaped sealing element has a sealing diameter, which equals the outer diameter of the balance drum.

Preferably, the non-rotary part is configured to be movable in the axial direction against the force of a spring element.

In this configuration with the spring element it is advantageous when the spring element is configured to push the non-rotary part in physical contact with the rotating part at standstill of the pump, so that the radial relief passage is closed. Thus, the spring element is designed as strong that it can press the non-rotary part of the additional balancing device in physical contact with the rotary part, at least as long as no hydraulic forces act upon the non-rotary part. Furthermore, the spring element is designed to be weak enough so that the hydraulic force acting on the non-rotary part during operation of the pump can move the non-rotary part in the axial direction against the force of the spring such that the radial relief passages is opened.

Furthermore, it is preferred that the contact faces with which the rotary part and the non-rotary part are in physical contact with each other are designed to withstand the friction during start-up or shutdown of the pump.

For this purpose the non-rotary part can comprise a stationary wear ring, which is configured such that the non-rotary part can physically contact the rotary part only with the stationary wear ring.

As an alternative or as a supplement the rotary part may comprise a rotary wear ring, which is configured such that the rotary part can physically contact the non-rotary part only with the rotary wear ring.

According to a preferred embodiment the additional balancing device and the spring element are configured to maintain a minimum width of the radial relief passage during operation of the pump. Thus, in particular the rotary part, the non-rotary part and the spring element are dimensioned and configured in such a manner that during operation of the pump a minimum width of the radial relief passage with respect to the axial direction is achieved, therewith considerably reducing the leakage flow of the fluid through the radial relief passage and the axial relief passage. In particular by the self-adjustment of the width of the radial relief passage it becomes possible to maintain the minimum width of the radial relief passage over the entire operating range of the pump. Thus, the efficiency of the pump can be considerably increased.

According to a preferred embodiment in particular for a single stage configuration of the pump or for a multistage configuration of the pump with an in-line arrangement of the impellers, the rotary part is arranged for being exposed to a pressure, which is at least essentially the same as the discharge pressure. This means with respect to the axial direction the additional balancing device is arranged adjacent to the last stage impeller in case of a multistage pump or to the only impeller in case of a single stage pump.

Furthermore, it is preferred that the suction pressure prevails at the low pressure location during operation of the pump. This is quite a simple design, because the balance line can just be connected to the inlet of the pump.

For many applications the pump can be configured as a multistage pump, wherein the hydraulic unit comprises at least a first stage impeller, and a last stage impeller, and optionally at least one intermediate stage impeller, with each impeller fixedly mounted on the pump shaft.

In particular when the pump is configured as a multistage pump with an in-line arrangement of the impellers it is preferred that the rotary part of the additional balancing device is arranged adjacent to the last stage impeller with respect to the axial direction.

In particular from the constructional point of view it is a preferred measure that the rotary part of the additional balancing device abuts against the balance drum.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION

Figure 1:
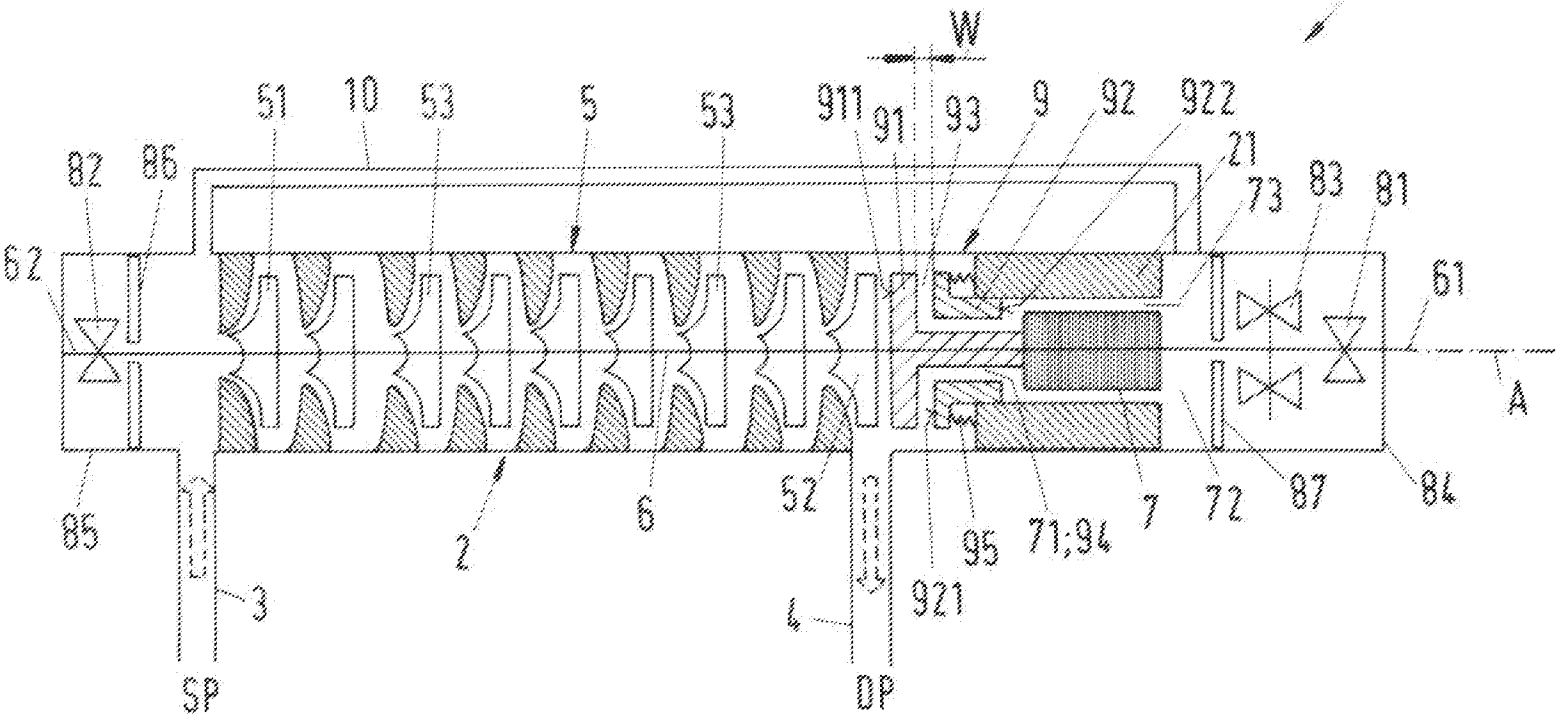
FIG. 1 is a schematic cross-sectional view of an embodiment of a rotary pump according to the invention.

FIG. 1 shows a schematic cross-sectional view of an embodiment of a rotary pump according to an embodiment of the invention, which is designated in its entity with reference numeral 1. The pump 1 is designed as a centrifugal pump for conveying a fluid, for example a liquid such as water.

The rotary pump 1 comprises a pump housing 2 having an inlet 3 and an outlet 4 for the fluid to be conveyed. The inlet 3 is arranged on a suction side and receives the fluid having a suction pressure SP. The outlet 4 is arranged on a discharge side and discharges the fluid having a discharge pressure DP, wherein the discharge pressure DP is larger than the suction pressure SP. The pump 1 further comprises a hydraulic unit 5 for conveying the fluid from the inlet 3 the outlet 4 and for pressurizing the fluid from the suction pressure SP such that the fluid is discharged at the outlet 4 with the discharge pressure DP. In FIG. 1 the flow of the fluid is indicated by the dashed arrows without reference numerals, The hydraulic unit 5 comprises at least one impeller 51, 52, 53 for acting on the fluid.

The pump further comprises a pump shaft 6 for rotating each impeller 51, 52, 53 about an axial direction A. The axial direction A is defined by the axis of the pump shaft 6. A direction perpendicular to the axial direction A is referred to as a radial direction. The pump shaft 6 extends from a drive end 61 to a non-drive end 62. In this embodiment of the pump the drive end 61 of the pump shaft 6 is located outside of the pump housing 2 and can be connected to a drive unit (not shown) for driving the rotation of the pump shaft 6 about the axial direction A. The drive unit can comprise, for example, an electric motor. Each impeller 51, 52, 53 is mounted to the pump shaft 6 in a torque proof manner.

In the following description reference is made by way of example to an embodiment, which is suited for many applications, namely that the rotary pump 1 is configured as a multistage pump 1, wherein the hydraulic unit 5 comprises a plurality of impellers 51, 52, 53, namely at least a first stage impeller 51, a last stage impeller 52, and optionally at least one intermediate stage impeller 53, with each impeller 51, 52, 53 fixedly mounted on the pump shaft 6. The impellers 51, 52, 53 are arranged one after another on the pump shaft 6. The reference numeral 51 designates the first stage impeller, which is arranged closest to the inlet 3 for receiving the fluid with the suction pressure SP. The reference numeral 52 designates the last stage impeller 52, which is the impeller 52 closest to the outlet 4. The last stage impeller 52 pressurizes the fluid such, that the fluid is discharged through the outlet 4 with the discharge pressure DP. The reference numeral 53 designates an intermediate stage impeller 53. Each intermediate stage impeller 53 is arranged between the first stage impeller 51 and the last stage impeller 52 when viewed in the direction of increasing pressure.

The embodiment shown in FIG. 1 has nine stages, i.e. the hydraulic unit 5 comprises the first stage impeller 51, the last stage impeller 52 and seven intermediate stage impellers 53. Of course, the number of nine stages has to be understood exemplary. The plurality of impellers 51, 52, 53 may be arranged in an in-line configuration as shown in FIG. 1 or in a back-to-back configuration. In case of embodiments of the pump 1 as a single stage pump the hydraulic unit includes only one impeller constituting the first stage impeller 51 or the last stage impeller 52, respectively.

The multistage rotary pump 1 shown in FIG. 1 is designed as a horizontal pump, meaning that during operation the pump shaft 6 is extending horizontally, i.e. the axial direction A is perpendicular to the direction of gravity. The rotary pump 1 shown in FIG. 1 is configured without an outer barrel casing, for example as a BB4 type pump. In other embodiments, the rotary pump 1 may be designed as a horizontal barrel casing multistage pump, i.e. as a double-casing pump.

It has to be understood that the invention is not restricted to the embodiment of the rotary pump 1. In other embodiments, the rotary pump can be designed for example as a vertical pump, meaning that during operation the pump shaft 6 is extending in the vertical direction, which is the direction of gravity.

The rotary pump 1 comprises bearings on both sides of the hydraulic unit 5 (with respect to the axial direction A), i.e. the rotary pump 1 is designed as a between-bearing pump. A first radial bearing 81, a second radial bearing 82 and an axial bearing 83 are provided for supporting the pump shaft 6. The first radial bearing 81 is arranged adjacent to the drive end 61 of the pump shaft 6. The second radial bearing 82 is arranged adjacent or at the non-drive end 62 of the pump shaft 6. The axial bearing 83 is arranged between the hydraulic unit 5 and the first radial bearing 81 adjacent to the first radial bearing 81. The bearings 81, 82, 83 are configured to support the pump shaft 6 both in the axial direction A and in a radial direction. The radial bearings 81 and 82 are supporting the pump shaft 6 with respect to the radial direction, and the axial bearing 83 is supporting the shaft 6 with respect to the axial direction A. The first radial bearing 81 and the axial bearing 83 are arranged such that the first radial bearing 81 is closer to the drive end 61 of the shaft 6. Of course, it is also possible to exchange the position of the first radial bearing 81 and the axial bearing 83, i.e. to arrange the first radial bearing 81 between the axial bearing 83 and the plurality of impellers 5, 51, so that the axial bearing 83 is closer to the drive end 61 of the shaft 6.

In other embodiments the axial bearing 83 may be arranged next to the second radial bearing 82, i.e. next to the non-drive end 62 of the pump shaft 6. In such embodiments the axial bearing 83 may be arranged between the hydraulic unit 5 and the second radial bearing 82 or between the second radial bearing 82 and the non-drive end 62 of the pump shaft 6.

A radial bearing, such as the first or the second radial bearing 81 or 82 is also referred to as a "journal bearing" and an axial bearing, such as the axial bearing 83, is also referred to as an "thrust bearing". The first radial bearing 81 and the axial bearing 83 can be configured as separate bearings as shown in FIG. 1, but it is also possible that the first radial bearing 81 and the axial bearing 83 are configured as a single combined radial and axial bearing supporting the shaft both in radial and in axial direction.

Usually the bearings 81, 82, 83 are provided in separate bearing housings 84, 85, which are fixedly connected to the pump housing 2. The first radial bearing 81 and the axial bearing 83 are arranged in a first bearing housing 84 arranged adjacent to the drive end 61 of the pump shaft 6. The second radial bearing 82 is provided in a second bearing housing 85 arranged adjacent to the non-drive end 62 of the pump shaft 6.

All bearings 81, 82, 83 are preferably configured as antifriction bearings, such as ball bearings. Of course, it is also possible that some or all bearings 81, 82, 83 are configured as hydrodynamic bearings.

The rotary pump 1 further comprises two sealing devices, namely a first sealing device 86 for sealing the pump shaft 6 at the suction side adjacent to the first stage impeller 51 and the inlet 3, and a second sealing device 87 for sealing the pump shaft 6 between the hydraulic unit 5 and the first bearing housing 84. With respect to the axial direction A the first sealing device 86 is arranged between the hydraulic unit 5 an the second radial bearing 82, and the second sealing device 87 is arranged between the hydraulic unit 5 and the axial pump bearing 83. Both sealing devices 86, 87 seal the pump shaft 6 against a leakage of the fluid along the shaft 6 e.g. into the environment. Furthermore, by the sealing devices 86 and 87 the fluid can be prevented from entering the bearings 81, 82, 83. Preferably, each sealing device 86, 87 comprises a mechanical seal. Mechanical seals are well-known in the art in many different embodiments and therefore require no detailed explanation.

The rotary pump 1 further comprises a balance drum 7 for at least partially balancing the axial thrust that is generated by the hydraulic unit 5 during operation of the rotary pump 1. The balance drum 7 is fixedly connected to the pump shaft 6 in a torque proof manner and arranged between the hydraulic unit 5 and the drive end 61 of the pump shaft, more precisely, between the hydraulic unit 5 and the second sealing device 87. The balance drum 7 defines a front side 71 and a back side 72. The front side 71 is the side or the space facing the hydraulic unit 5. The back side 72 is the side or the space facing the second sealing device 87, i.e. the side or the space facing away from the hydraulic unit 5. The balance drum 7 is surrounded by a stationary part 21, so that an axial relief passage 73 is formed between the radially outer surface of the balance drum 7 and the stationary part 21. The stationary part 21 is configured to be stationary with respect to the pump housing 2. The axial relief passage 73 forms an annular gap between the outer surface of the balance drum 7 and the first stationary part 21 and extends in axial direction A from the front side 71 to the back side 72.

The axial relief passage 73 is also referred to as "axial gap" or as "axial labyrinth". The term "axial" designates that the relief passage 73 extends in the axial direction A, such that the fluid passing through said axial relief passage 73 flows in axial direction A, i.e. in a direction parallel to the pump shaft 6.

Furthermore, a balance line 10 is provided connecting the back side 72 with a low pressure location. The low pressure location is a location, where during operation of the pump 1 a pressure prevails, which is smaller than the pressure at the front side 71. Preferably the suction pressure SP prevails at the low pressure location. This is achieved in the embodiment of the pump 1 shown in FIG. 1 by connecting the balance line 10 to the inlet 3, so that the balance line 10 is in fluid communication with the inlet 10. Thus, the balance line 10 constitutes a flow connection between the back side 72 and the pump inlet 3. The balance line 10 may be arranged—as shown in FIG. 1—outside the pump housing 2. In other embodiments the balance line 10 can be designed as internal line completely extending within the pump housing 2.

According to embodiments of the invention, an additional balancing device 9 is arranged between the balance drum 7 and the hydraulic unit 5. For a better understanding FIG. 2 shows a more detailed cross-sectional view illustrating a configuration of the balance drum 7 and the additional balancing device 9.

The additional balancing device 9 comprises a ring-shaped rotary part 91 fixedly connected to the pump shaft 6, preferably in a torque proof manner, and a ring-shaped non-rotary part 92, which is movable only in the axial direction A and which is secured against a rotational movement, in particular against a rotation about the axial direction A. The rotary part 91 has an axial face 911 facing the hydraulic unit 5. In the embodiment of the pump shown in FIG. 1 the axial face 911 of the rotary part 91 faces the last stage impeller 52, and the axial face 911 is exposed to a pressure, which is at least essentially the same as the discharge pressure DP prevailing at the outlet 4 during operation of the pump 1. Of course, due to smaller pressure losses caused by the fluid communication between the outlet 4 and the rotary part 91 the pressure prevailing at the axial face 911 of the rotary part 91 can be somewhat smaller than the discharge pressure DP. However, this small difference will be neglected hereinafter.

It has to be noted that the rotary part 91 is not necessarily arranged adjacent to the last stage impeller 52. For example, in a multistage pump with a back-to-back arrangement of the impellers in the hydraulic unit, the rotary part of the additional balancing device can be arranged adjacent to an intermediate stage impeller of the hydraulic unit, namely this intermediate stage impeller which is arranged at the axial end of the hydraulic unit that is next to the balance drum. In such embodiments the pressure prevailing at the axial face of the rotary part is usually considerably smaller than the discharge pressure prevailing at the outlet of the pump, for example the pressure equals the suction pressure plus half the difference between the discharge pressure and the suction pressure.

Figure 2:
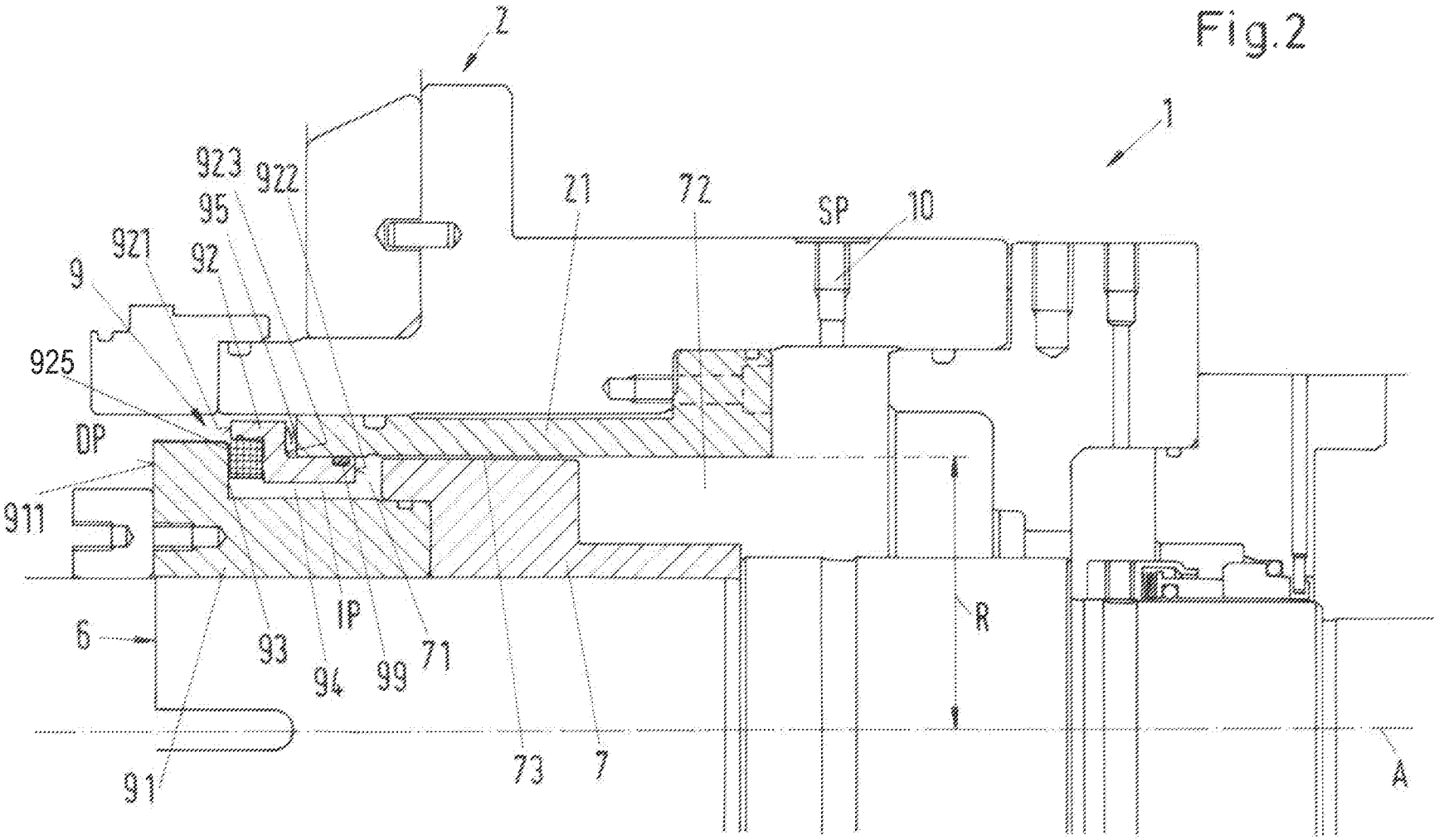
FIG. 2 is a more detailed cross-sectional view illustrating a configuration of the balance drum and the additional balancing device.

As it can be seen both in FIG. 1 and in FIG. 2, the rotary part 91 and the non-rotary part 92 are configured to overlap with respect to the radial direction, i.e. with respect to the direction perpendicular to the axial direction A. The non-rotary part 92 is configured to be movable in the axial direction A against the force of a spring element 95, such that a radial relief passage 93 is open during operation of the pump 1. The radial relief passage 93 extends in the radial direction between the rotary part 91 and the non-rotary part 92.

It has to be noted that the spring 95 is not necessarily required. In other embodiments the axial position of the non-rotary part 92 or the movement of the non-rotary part 92 in axial direction A, respectively, may be determined by hydraulic forces only, or by the combination of hydraulic forces with for example gravitational forces, friction forces, magnetic forces or other forces.

The radial relief passage 93 is also referred to as "radial gap" or as "radial labyrinth". The term "radial" designates that the relief passage 93 extends in the radial direction, such that the fluid passing through said radial relief passage 93 flows in radial direction, i.e. in a direction perpendicular to the pump shaft 6.

In the embodiment shown in FIG. 1 and FIG. 2 the spring element 95 acting on the non-rotary part 92 rests on the stationary part 21 delimiting the axial relief passage 73. The spring element 95 can comprise a helical spring or a disk spring or a spring collar or a spring washer or any other spring-elastic element, which is suited to exert a force on the non-rotary part 92, which is directed in axial direction A towards the rotary part 91.

When the non-rotary part 92 moves in the axial direction A, it moves relative to the stationary part 21. A ring-shaped sealing element 99, for example an O-ring, is provided between the stationary part 21 and the non-rotary part 92 for sealing therebetween.

At the front side 71 in front of the balance drum 7 an annular chamber 94 is provided between the balance drum 7 and the rotary part 91 of the additional balancing device 9. On the one side, the balance drum 7 delimits the annular chamber 94 with respect to the axial direction A. On the other side the annular chamber 94 is delimited with respect to the axial direction A by the rotary part 91. With respect to the radial direction the annular chamber 94 is delimited at the radially inner side by the rotary part 91 and at the radially outer side by the non-rotary member 92. Thus, the annular chamber 94 extends between the rotary part 91 and the non-rotary part 92 with respect to the radial direction. With respect to the axial direction A the annular chamber 94 extends between the rotary part 91 and the balance drum 7.

Preferably, as it is shown in FIG. 2 the rotary part 91 of the additional balancing device 9 abuts against the balance drum 7. The balance drum 7 has a recess at the front site 71, which is configured to receive the end of the rotary part 91.

The non-rotary part 92 comprises a first axial face 921 and a second axial face 922 delimiting the non-rotary part 92 with respect to the axial direction A, wherein the first axial face 921 is arranged to be exposed to the same pressure as the axial face of the rotary part 91 facing the hydraulic unit 5, here namely the discharge pressure DP, and wherein the second axial face 922 is arranged to be exposed to the pressure prevailing in the annular chamber 94. The non-rotary part 92 is interposed—with respect to the axial direction—between the rotary part 91 and the stationary part 21.

The pressure prevailing in the annular chamber 94 during operation of the pump 1 is referred to as intermediate pressure IP. The intermediate pressure IP is smaller than the discharge pressure DP and larger than the suction pressure SP as will be explained hereinafter.

In the embodiment shown in FIG. 2, the non-rotary part 92 comprises a third axial face 923, which is arranged between the first axial face 921 and the second axial face 922 with respect to the axial direction. The non-rotary part 92 is configured such, that the first axial face 921 and the third axial face 923 have the same outer diameter. The outer diameter of the second axial face 922 is smaller than the outer diameter of the first and the third axial face 921, 923.

The outer diameter of the third axial face 923 is dimensioned such, that the third axial face 923 and the stationary part 21 overlap with respect to the radial direction, so that a ring-shaped chamber is formed between the stationary member 21 and the third axial face 923. In said ring-shaped chamber the spring element 95 is arranged, wherein the spring element 95 rests both on the third axial face 923 and the stationary part 21.

Furthermore, the outer diameter of the first and the third axial face 921 and 923 is dimensioned such that the third axial face 923 is exposed to the same pressure as the first axial face 921 during operation of the pump 1, i.e. the fluid may flow from the high pressure side in front of the first axial face 921 into the ring-shaped chamber, where the spring element 95 is located.

The ring-shaped sealing element 99 is arranged at the radially outer surface of the non-rotary part 92 between the second axial face 922 and the third axial face 923 with respect to the axial direction A. Consequently, the ring-shaped sealing element 99 has a sealing diameter which equals—at least essentially—of the second axial face 922 of the non-rotary part 92. In FIG. 2 the reference numeral R denotes the radius R of the ring-shaped sealing element 99. Thus, the sealing diameter of the ring-shaped sealing element 99 equals two times the radius R.

Preferably, the sealing diameter of the ring-shaped sealing element 99 equals the outer diameter of the balance drum 7 as it is shown in FIG. 2. The outer diameter of the balance drum 7 is given by the axial thrust that has to be generated by the balance drum 7 to at least partially compensate the hydraulic thrust generated by the rotating impellers 51, 52, 53 during operation of the pump 1. Thus, in practice, for a specific application the outer diameter two times R of the balance drum 7 is determined depending on the required balancing forces that have to be generated by the balance drum 7. When the outer diameter of the balance drum 7 has been determined, the additional balancing device 9 is configured such that the ring-shaped sealing element 99 at the non-rotary part 92 has a sealing diameter, which is at least essentially the same as the outer diameter of the balance drum 7.

As already mentioned, the ring-shaped sealing element 99 may be for example a O-ring, which is arranged e.g. in a circumferential groove provided in the outer surface of the non-rotary part 92. Of course, the ring-shaped sealing element 99 may also be configured as a metallic sealing element 99 or as a sealing element 99 made of a graphite compound material or a plastic, e.g. a thermoplastic polymer such as polyether ether ketone (PEEK) or polytetrafluorethylene (PTFE). The ring-shaped sealing element 99 may also be configured as a coating on the non-rotary part 92. Furthermore, the ring-shaped sealing element may be configured as a labyrinth sealing.

The non rotary part 92 comprises a stationary wear ring 925 arranged at the first axial face 921. The stationary wear ring is configured such that the non-rotary part 92 can physically contact the rotary part 91 only with the stationary wear ring 925. During operating conditions of the pump, when the rotary part 91 and the non-rotary part 92 are in physical contact with each other the stationary wear ring 925 ensures that the rotary part 91 and the non-rotary part 92 to withstand the friction. Such operating conditions occur for example during start-up or shutdown of the pump 1.

As an alternative or as a supplement the rotary part 91 can comprise a rotary wear ring (not shown), which is configured such that the rotary part 91 can physically contact the non-rotary part 92 only with the rotary wear ring.

The stationary wear ring 925 and/or the rotary wear ring have a Wear resistant surface, e.g. a coating or they are manufactured from a wear resistant material, which withstand the friction between the rotary part 91 and the non-rotary part 92. An example for such a material is a thermoplastic polymer such as polyether ether ketone (PEEK). Another example is a graphite compound material.

As an alternative to providing the separate wear ring 925 it is also possible to configure the non-rotary part 92 in one piece, i.e. without a separate wear ring 925. In such embodiments the entire non-rotary part 92 may consist e.g. of a metallic material or a graphite compound material or a plastic material such as PEEK or PTFE. In such embodiments also the ring-shaped sealing element 99 may be formed integrally, i.e. in one piece, with the non-rotary part 92.

The spring element 95 is configured to push the non-rotary part 91 in physical contact with the rotary part 92 at standstill of the pump 1, so that the radial relief passage 93 is closed.

Thus, at stillstand of the pump 1 the spring element 95 pushes the non-rotary element 92 against the rotary part 91, so that the radial relief passage 93 is closed and the stationary wear ring 925 of the non-rotary part 82 is in physical contact with the rotary part 91.

During start-up of the pump 1 the hydraulic force acting both on the non-rotary part 92, more precisely on the first axial face 921 of the non-rotary part 92, and on the rotary part 91, more precisely on the axial face 911 of the rotary part 91, increases until the pump 1 reaches its nominal speed. The hydraulic force pushes the non-rotary part 92 away from the rotary part 91 against the force of the spring element 95, namely to the right according to the representation in FIG. 1 and FIG. 2, so that the radial relief passage 93 opens between the rotary part 91 and the non-rotary part 92 of the additional balancing device 9. The fluid flows through the radial relief passage 93, into the annular chamber 94 at the front side 71 of the balance drum 7 and then through the axial relief passage 73 along the balance drum 7 to the back side 72 and into the balance line 10.

When the start-up of the pump 1 is finished and the pump 1 has reached its nominal speed or the desired speed, the discharge pressure DP prevails at the outlet 4 as well as on the axial face 911 of the rotary part 91 and on the first axial face 921 of the non-rotary part 92. At the inlet 3 as well as on the back side 72 the suction pressure SP prevails. Due to the opening of the radial relief passage 93, the intermediate pressure IP prevails in the annular chamber 94. The intermediate pressure IP is anywhere between the discharge pressure DP and the suction pressure SP.

By this combination of the radial relief passage 93 and the axial relief passage 73 the overall leakage flow through the additional balancing device 9 and along the balance drum 7 can be considerably reduced as compared to known balancing systems having a balance drum only. Although the overall leakage flow is considerably reduced the balancing action regarding the axial thrust is at least not considerably reduced as compared to known balancing systems.

The front side 71 is located in the annular chamber 94, so that during operation of the pump 1 the axial surface of the balance drum 7 facing the front side 71 is exposed to the intermediate pressure IP prevailing in the annular chamber 94 Therefore, a considerably large pressure drop takes place over the balance drum 7. At the back side 72 essentially the suction pressure SP prevails due to the balance line 10.

Since the front side 71 is exposed essentially to the intermediate pressure IP, the pressure drop exists over the balance drum 7 so that the two axial faces delimiting the balance drum 7 with respect to the axial direction A are exposed to different pressures, namely one is exposed to the intermediate pressure IP prevailing in the annular chamber 94 and the other one is exposed to the suction pressure SP. This results in a force that is directed in axial direction A to the left side according to the representation in FIG. 2, therewith counteracting the axial thrust generated by the hydraulic unit 5 during operation of the pump 1.

During operation of the pump 2 the radial relief passage 93 has a width W (see FIG. 1). The width W, i.e. the extension of the radial relief passage 93 measured in the axial direction A is self-adjusting. As already explained, the first axial face 921 of the non-rotary part 92 is exposed to the same pressure as the axial face 911 of the rotary part 91 facing the hydraulic unit 5, namely essentially the discharge pressure DP. The second axial face 922 of the non-rotary part is exposed to the intermediate pressure IP prevailing in the annular chamber 94. Thus, the width W of the radial relief passage 93 depends on the difference between the discharge pressure DP times the first axial face 921 exposed to the discharge pressure DP and the intermediate pressure IP times the second axial face 922 exposed to the intermediate pressure IP.

If, during operation of the pump 1, the discharge pressure DP acting of the first axial face 921 of the non-rotary part 92 increases, the width W of the radial relief passage 93 increases, meaning that the radial relief passage 93 becomes broader with respect to the axial direction A. Consequently the leakage flow through the radial relief passage 93 into the annular chamber 94 increases, whereby the resistance for the fluid flowing through the axial relief passage 73 along the balance drum 7 increases. This leads to an increase of the intermediate pressure IP prevailing in the annular chamber 45. Since the second axial face 921 of the non-rotary part 92 is exposed to the intermediate pressure IP, the force acting on said second axial face 921 increases and, hence, the non-rotary part 92 of the additional balancing device 9 moves towards the rotary part 91, whereby the width W of the radial relief passage 93 is reduced. In an analogous manner the with W of the radial relief passage 93 is self-adjusting in case the discharge pressure decreases.

The additional balancing device 9 and the spring element 95 are configured to maintain a minimum width W of the radial relief passage 93 during operation of the pump 1. Thus, in particular the rotary part 91, the non-rotary part 92 and the spring element 95 are dimensioned and configured in such a manner that during operation of the pump 1 a minimum width W of the radial relief passage 93 is achieved, therewith considerably reducing the leakage flow of the fluid through the radial relief passage 93 and the axial relief passage 73. In particular, by the self-adjustment of the width W of the radial relief passage 93 it is possible to maintain the minimum width W of the radial relief passage 93 over the entire operating range of the pump 1. Thus, the efficiency of the pump 1 may be considerably increased due to the reduction of the leakage flow.

What is claimed:

1. A rotary pump for conveying a fluid, comprising:

a pump housing with an inlet to receive the fluid having a suction pressure, an outlet to discharge the fluid having a discharge pressure;

a pump shaft configured to rotate about an axial direction;

a hydraulic unit configured to convey and pressurize the fluid, the hydraulic unit comprising at least one impeller fixedly mounted on the pump shaft;

a balance drum fixedly connected to the pump shaft and arranged between the hydraulic unit and an end of the pump shaft, the balance drum defining a high pressure, front side facing the hydraulic unit and a low pressure back side facing away from the hydraulic unit, an axial relief passage disposed between the balance drum and a stationary part configured to be stationary with respect to the pump housing and connecting the high pressure front side with the low pressure back side;

a balance line connecting the low pressure back side with a low pressure location; and a balancing device arranged between the balance drum and the hydraulic unit, the balancing device comprising a ring-shaped rotary part fixedly connected to the pump shaft, and a ring-shaped non-rotary part, which is movable only in the axial direction, the rotary part having an axial face facing the hydraulic unit, the rotary part and the non-rotary part configured to overlap with respect to a radial direction, which is perpendicular to the axial direction, and the non-rotary part configured to be movable in the axial direction such that a radial relief passage is open during operation of the pump, with the radial relief passage extending in the radial direction between the rotary part and the non-rotary part.

2. The rotary pump in accordance with claim 1, wherein the balance drum delimits an annular chamber arranged at the high pressure front side, and the annular chamber extends between the rotary part and the non-rotary part with respect to the radial direction.

3. The rotary pump in accordance with claim 2, wherein the non-rotary part comprises a first axial face and a second axial face delimiting the non-rotary part with respect to the axial direction, the first axial face is arranged to be exposed to a same pressure as the axial face of the rotary part facing the hydraulic unit, and the second axial face is arranged to be exposed to the pressure prevailing in the annular chamber.

4. The rotary pump in accordance with claim 3, wherein the non-rotary part comprises a third axial face, which is arranged between the first axial face and the second axial face with respect to the axial direction, the third axial face is exposed to the same pressure as the first axial face during operation of the pump.

5. The rotary pump in accordance with claim 4, wherein a ring-shaped sealing element is arranged at a radially outer surface of the non-rotary part, and the ring-shaped sealing element is arranged between the second axial face and the third axial face with respect to the axial direction.

6. The rotary pump in accordance with claim 5, wherein the ring-shaped sealing element has a sealing diameter, which is approximately equal to an outer diameter of the balance drum.

7. The rotary pump in accordance with claim 1, wherein the non-rotary part is configured to be movable in the axial direction against a force of a spring element.

8. The rotary pump in accordance with claim 7, wherein the spring element is configured to push the non-rotary part in physical contact with the rotary part at a standstill of the pump, so that the radial relief passage is closed.

9. The rotary pump in accordance with claim 1, wherein the non-rotary part comprises a stationary wear ring configured such that the non-rotary part is capable of physically contacting the rotary part only with the stationary wear ring.

10. The rotary pump in accordance with claim 7, wherein the balancing device and the spring element are configured to maintain a minimum width of the radial relief passage during operation of the pump.

11. The rotary pump in accordance with claim 1, wherein the rotary part is arranged so as to be exposed to a pressure, which is at least essentially the same as the discharge pressure.

12. The rotary pump in accordance with claim 1, Wherein the suction pressure prevails at a low pressure location during operation of the pump.

13. The rotary pump in accordance with claim 1, wherein the at least one impeller comprises at least a first stage impeller, and a last stage impeller, and each impeller is fixedly mounted on the pump shaft.

14. The rotary pump in accordance with claim 10, wherein the at least one impeller comprises at least a first stage impeller, and a last stage impeller, and the rotary part of the balancing device is arranged adjacent to the last stage impeller with respect to the axial direction.

15. The rotary pump in accordance with claim 1, wherein the rotary part of the balancing device abuts against the balance drum.

16. The rotary pump in accordance with claim 1, wherein the at least one impeller comprises at least a first stage impeller, a last stage impeller, and at least one intermediate stage impeller and each impeller is fixedly mounted on the pump shaft.

* * * * *